US008317887B2

(12) United States Patent
Charles

(10) Patent No.: US 8,317,887 B2
(45) **Date of Patent: *Nov. 27, 2012**

(54) MIXTURE TO ADD ODOUR TO AN ODOURLESS COMBUSTIBLE GAS

(75) Inventor: Patrick Charles, Sauvageon (FR)

(73) Assignee: Arkema France, Colombes (FR)

( * ) Notice: Subject to any disclaimer, the term of this patent is extended or adjusted under 35 U.S.C. 154(b) by 43 days.

This patent is subject to a terminal disclaimer.

(21) Appl. No.: 12/306,007

(22) PCT Filed: Jun. 25, 2007

(86) PCT No.: PCT/FR2007/051512

§ 371 (c)(1),
(2), (4) Date: Dec. 22, 2008

(87) PCT Pub. No.: WO2008/001000

PCT Pub. Date: Jan. 3, 2008

(65) Prior Publication Data

US 2009/0300987 A1 Dec. 10, 2009

Related U.S. Application Data

(60) Provisional application No. 60/858,587, filed on Nov. 13, 2006.

(30) Foreign Application Priority Data

Jun. 26, 2006 (FR) ..... 06 52636

(51) Int. Cl.
*C10J 1/28* (2006.01)

(52) U.S. Cl. ..... 48/195; 44/413; 44/388

(58) Field of Classification Search ..... 48/195; 44/413, 388

See application file for complete search history.

(56) References Cited

U.S. PATENT DOCUMENTS

| | | | | |
|---|---|---|---|---|
| 3,816,267 | A | 6/1974 | Chuang | |
| 5,322,960 | A * | 6/1994 | Sakamoto et al. | 560/205 |
| 5,877,344 | A * | 3/1999 | Gande et al. | 560/205 |
| 7,108,803 | B1 * | 9/2006 | Mansfeld et al. | 252/372 |
| 2005/0258402 | A1 | 11/2005 | Haubs et al. | |
| 2006/0009372 | A1 * | 1/2006 | Mansfeld et al. | 512/8 |
| 2007/0219113 | A1 | 9/2007 | Patrick | |

FOREIGN PATENT DOCUMENTS

| | | |
|---|---|---|
| CA | 2550273 | * 12/2004 |
| JP | 49131201 | 4/1973 |
| JP | 55137190 | 10/1980 |
| JP | 4173895 | 6/1992 |
| JP | 8060167 | 3/1996 |
| PL | 72057 | 5/1973 |
| WO | WO 2005/061680 | 7/2005 |

OTHER PUBLICATIONS

Volodarsky, L., "Advances in the Chemistry of Stable Nitroxides", Janssen Chimica Acta, 8(1990), No. 3, GB, pp. 12-19.

* cited by examiner

*Primary Examiner* — Cephia D Toomer
*Assistant Examiner* — Monique Cole
(74) *Attorney, Agent, or Firm* — Smith, Gambrell & Russell, LLP

(57) ABSTRACT

Mixture to be employed specifically as an agent for adding an odour to a gaseous combustible fuel such as natural gas, consisting of: at least one alkyl acrylate (I) of which the alkyl radicals contain from one to 12 carbon atoms; at least on compound of formula (II) in a quantity sufficient to inhibit the polymerization of the alkyl acrylate or acrylates(I) in the presence and/or absence of oxygen.

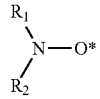

16 Claims, No Drawings

MIXTURE TO ADD ODOUR TO AN ODOURLESS COMBUSTIBLE GAS

FIELD OF THE INVENTION

The present invention concerns the field of odorizers for gaseous fuels, especially odorless ones, and more especially relates to odorizing compositions that are free of sulfur compounds, for detecting gas leaks and preventing risks of explosion resulting therefrom.

BACKGROUND OF THE INVENTION

The mains gases and coke oven gases that were obtained via thermal processes were used for a long time in the past as gaseous fuels, both for public lighting and for domestic needs. These gases contained strongly odoriferous components. They consequently had a strong intrinsic odor, enabling a gas leak to be easily detected.

In contrast, the gaseous fuels used nowadays, whether natural gas, propane, butane, liquefied petroleum gas (or LPG), or even oxygen (for example for welding), are essentially odorless, either on account of their origin or on account of the purification treatment they have received.

Thus, if leaks are not perceived in time, explosable mixtures of gaseous fuels and air rapidly form, with a consequential high risk potential.

It is for these safety reasons that the natural gas circulating in gas pipelines is odorized by injection (in specialized plants) of suitable additives known as odorizers.

Natural gas is generally conveyed in odorless form to consumer countries from the production sites, after a suitable purification treatment, either via a gas pipeline, or (in liquid form) in specialized ships (methane tankers). In France, for example, natural gas is thus received at a limited number of injection plants, where the odorizer is injected, such that the natural gas both which circulates in the French gas pipeline network and which is stored in underground reservoirs is odorized, thus allowing easy detection in the event of a leak, irrespective of the portion of the network in which this leak occurs.

In other countries, natural gas may be distributed throughout the territory via a network of gas pipelines in which it circulates without an odorizer, the gas then being odorized on entering the towns where it is consumed, hence the need for an even larger number of injection plants.

Storage tanks are usually maintained under an atmosphere of nitrogen or of natural gas in order to limit, at this stage, the risks of explosion.

It is known practice to use alkyl sulfides and/or mercaptans as odorizers, alone or as a mixture. Examples that may be mentioned include diethyl sulfide, dimethyl sulfide, methyl ethyl sulfide, tetrahydrothiophene, tert-butyl mercaptan and isopropyl mercaptan, which are widely used for their excellent properties, being especially capable of triggering a sensation of alarm among people in the event of an accidental leak of the natural gas thus odorized, and of initiating the necessary safety operations within the briefest of delays.

However, during the combustion of natural gas, these products generate an amount of sulfur dioxide which, small as it may be, becomes non-negligible when an overall account is taken at the scale of a country or a region, especially one with a high level of industrialization or of urbanization. Thus, for example, the combustion of a natural gas odorized with tetrahydrothiophene (THT) at a concentration of 10 mg/Nm$^3$ (or number of m$^3$ of gas, measured under standard temperature and pressure conditions) generates 7.3 mg/Nm$^3$ of sulfur dioxide.

In the general context of better assimilation of environmental constraints, it is thus necessary to reduce the amounts of $SO_2$ discharged into the atmosphere via the odorizers present in natural gas, during the combustion thereof.

Many odorizing mixtures free of sulfur compounds have been proposed.

Examples that may be mentioned include PL 72057, which describes odorizing mixtures based on dicyclopentadiene, JP-41-73895, which describes mixtures of specific ethers and esters, WO 02/42396, which describes mixtures based on norbornene or derivatives thereof, and JP-80-060 167, which describes mixtures based on 5-ethylidene-2-norbornene and a 2-alkoxy-3-alkylpyrazine.

Many documents describing odorizing mixtures based on alkyl acrylates are also known:

JP-49-131 201 describes a gaseous fuel odorizer based on an acrylate $CH_2{=}CHCO_2{-}R1$ where R1 is a saturated or unsaturated hydrocarbon-based chain containing 3 carbon atoms and/or based on an ether R2—O—R3 where R2 is an unsaturated hydrocarbon-based chain containing 2 or 3 carbon atoms and R3 is a saturated or unsaturated hydrocarbon-based chain containing 2 or 3 carbon atoms.

DE 198 37 066 describes a process for odorizing natural gas by adding a mixture comprising an alkyl acrylate, a nitrogenous compound of pyrazine type, and an antioxidant. However, this mixture has the drawback of not having a characteristic odor of gas and is thus liable to lead to confusion in the event of a gas leak. The risk is, quite obviously, that of not detecting this leak, and thus of explosion, if the concentration of gas in the air reaches its lower explosiveness limit.

Documents are also known that combine sulfur compound(s) and non-sulfur compound(s), such as JP-55-137 190, which describes an odorizing mixture combining ethyl acrylate with a specific sulfur compound, namely tert-butyl mercaptan (or TBM). However, the major drawback of this mixture is that, on account of the chemical reactivity of TBM with ethyl acrylate, the two components of the odorizing mixture must be stored, at the various injection plants, in separate tanks and also require separate pumps and injection heads for introduction into the gas pipeline. With regard to the complex logistics for odorizing natural gas presented hereinabove, this results in a considerable increase in costs for the injection plants, arising from the necessary multiplication of the storage tanks, pumps and injection heads; WO 2004/024 852 describes an odorizer constituted of four components, including an alkyl acrylate, an alkyl sulfide and a stabilizing antioxidant such as tert-butylhydroxytoluene, hydroquinone, etc.; WO 2005/103 210 describes an odorizing mixture for odorless gaseous fuel, constituted of an alkyl sulfide, an alkyl acrylate and a compound for inhibiting the polymerization of the alkyl acrylate, of nitroxide type.

It is known that acrylates are highly reactive monomers that can polymerize spontaneously, especially on storage, to form polyacrylates. Such an uncontrolled polymerization is liable to place in danger people located in proximity to the injection plants, such as local residents or maintenance workers, due to the risk of explosion. This polymerization arising during storage, including, for example, in the storage tanks or vats of the injection plants, may also lead to rapid fouling or even blocking of the pipes between the storage tanks and the point of injection. Such a phenomenon may lead to an uncontrolled drop in the concentration of odorizer in the natural gas, which increases the risk associated with an undetected gas leak.

To avoid this, hydroquinones are commonly added to acrylate-based odorizing compositions to inhibit their polymerization, as taught in U.S. Pat. No. 3,816,627, which concerns the manufacture of acrylate. In order to function, the hydroquinone-based inhibiting system needs oxygen, since the active form of the inhibitor is a molecule comprising a radical that is formed following the reaction of the inhibitor with oxygen and traps the polymerization precursors. This inhibitor requires storage of the odorizing mixture in air. This condition is not respected when an odorizer storage tank is under pressure of natural gas, which makes it possible to increase the yield of the pumps for injecting odorizer into the gas. Storage under nitrogen also exists. In this case, as with natural gas, the hydroquinone cannot react with oxygen to form a radical and therefore does not play its role of inhibitor, which places the user in danger of risk of explosion following an uncontrolled polymerization, but also may cause fouling or even rapid blocking of the pipes between the storage reservoir and the point of injection. The consequence of this latter point is an uncontrolled drop in the concentration of odorizer in the gas, leading to an increased risk of explosion due to undetected gas leaks.

DETAILED DESCRIPTION OF THE INVENTION

The odorizing mixture based on alkyl acrylate(s) according to the invention can overcome the drawbacks described above due not only to the absence of sulfur compound in the mixture (no release of $SO_2$), but also to the absence of oxygen required for activation of the non-nitroxyl polymerization inhibitors. The odorizing mixture according to the invention shows stability on storage, irrespective of the nature of the covering gas, which may or may not contain oxygen.

In contrast with other inhibitors such as radical inhibitors belonging to the hydroquinone family, the inhibitors do not require storage of the odorizing composition in air, whereas storage in air is necessary for radical inhibitors of hydroquinone type. This has the advantage, at the gas injection plants, of enabling the storage of the odorizing composition in a suitable tank under pressure of natural gas and thus of being able to increase the yield of the injection pumps.

The odorizing compositions according to the invention can also, in certain natural gas injection plants in which the storage tanks are under nitrogen, be stored under nitrogen.

One subject of the present invention is a composition that can be used especially as an odorizer for a gaseous fuel, more particularly natural gas, comprising:

at least one alkyl acrylate (I) in which the alkyl radical contains from 1 to 12 and preferably from 1 to 8 carbon atoms;

at least one compound of formula (II) in an amount sufficient to inhibit the polymerization of the alkyl acrylate(s) (I) in the presence and/or absence of oxygen

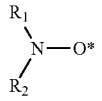

in which:

$R_1$ and $R_2$, which may be identical or different, each represent a tertiary or secondary hydrocarbon-based radical containing from 2 to 30 and preferably from 4 to 15 carbon atoms, and optionally one or more heteroatoms chosen from sulfur, phosphorus, nitrogen and oxygen; or $R_1$ and $R_2$, taken with the nitrogen atom to which they are attached, form a cyclic hydrocarbon-based radical containing from 4 to 10 and preferably from 4 to 6 carbon atoms, said radical being optionally substituted.

The compounds of formula (I) are preferably chosen from methyl, ethyl, n-propyl, isopropyl, n-butyl, isobutyl, tert-butyl, pentyl, hexyl, heptyl, octyl and/or dodecyl acrylates, and are advantageously chosen from methyl acrylate, ethyl acrylate and/or n-butyl acrylate.

The compounds of formula (II) are known per se; their preparation is described, for example, in the book "Synthetic Chemistry of Stable Nitroxides" by L. B. Volodarsky et al., CRC Press, 1993, ISBN: 0-8493-4590-1.

According to one particularly preferred variant, the composition according to the invention comprises as inhibitor of formula (II) at least one compound derived from tetramethylpiperidine oxide (also known as TEMPO) of formula (IIa):

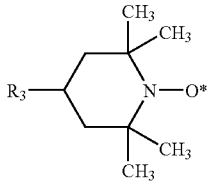

in which $R_3$ represents a hydroxyl, amino, ester or amide group, preferably $R_3COO$— or $R_3CON$— in which $R_3$ is a $C_1$-$C_4$ alkyl radical.

It is advantageously preferred to select the compound of formula (IIb) from at least one of the following compounds:

-N-(tert-butyl)-N-(1-[ethoxy(ethyl)phosphino]propyl) nitroxide of formula:

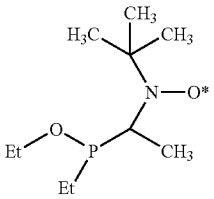

-N-(tert-butyl)-N-(1-diethylphosphono-2,2-dimethylpropyl) nitroxide of formula:

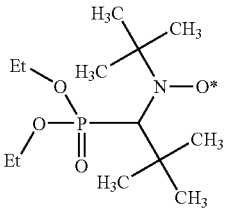

-N-(tert-butyl)-N-([2-methyl-1-phenyl]propyl) nitroxide of formula:

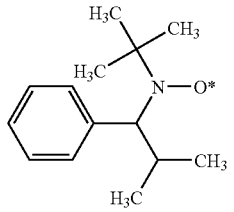

According to one preferred variant of the composition according to the invention, the polymerization inhibitor(s) (II) is (are) used in an amount of from 50 ppb to 1000 ppm by weight relative to the mass of acrylate(s) present in the mixture.

The odorizing composition according to the invention gives gaseous fuels, especially natural gas after it has been injected therein, a strong odorous power, comparable to that obtained with odorizers based on alkyl sulfides or mercaptans of the prior art, thus enabling any person present in the vicinity of a leak to recognize it and to instigate the appropriate safety measures. This strong odorous power is obtained simultaneously with the disappearance of $SO_2$ discharged into the ecosphere after combustion of the gas thus odorized.

Finally, this composition may be used in injection plants by means of a single storage tank, a single pump and a single injection head, which leads to considerably simplified logistics.

A subject of the present invention is also a process for odorizing an odorless gaseous fuel, comprising the addition of an effective amount of an odorizing composition defined previously comprising at least one alkyl acrylate and at least one compound (II) for inhibiting the polymerization of the alkyl acrylates, which is stable in the presence and in the absence of oxygen. The amount of said composition may be determined by a person skilled in the art by means of routine tests, taking into account the particular characteristics of the gaseous fuel, and of the distribution networks.

Purely as a guide, this effective amount is generally between 1 and 500 mg/Nm$^3$ and preferably between 2 and 50 mg/Nm$^3$.

The composition according to the invention described above may be used in its native form or may be diluted in a solvent or a mixture of solvents that is inert with respect to acrylates. Examples of solvents that may be mentioned include cyclohexane and n-hexane. The dilution of the composition may be up to 85%, i.e. 15 parts by weight of the composition according to the invention are diluted in 85 parts by weight of solvent.

The gaseous fuels to which the process according to the invention applies include: natural gas, propane, butane, liquefied petroleum gas (or LPG), or even oxygen or hydrogen, such as the gas generated by fuel cells.

Natural gas is a preferred gaseous fuel according to the present invention on account of its very broad diffusion and the magnitude of the distribution networks, making the reduction of any danger resulting from a risk of a leak particularly desirable.

As regards natural gas, the composition that may be used as odorizer is added by injection in specialized plants according to the usual techniques used in this field.

The examples that follow are given purely as an illustration of the invention and shall not in any way be interpreted as limiting the scope thereof.

EXAMPLE 1 (REFERENCE)

Odorization of Natural Gas with Tetrahydrothiophene 10 mg per Nm$^3$ of tetrahydrothiophene are injected into natural gas by means of a suitable laboratory device.

The content of sulfur dioxide formed, after combustion of the gas thus odorized, is equal to 7.3 mg/Nm$^3$.

The gas thus odorized is subjected to an olfactory test, from which it emerges that it has a strong odorous power and thus good warning power.

EXAMPLE 2

The following composition is obtained by simple mixing of the components in the proportions indicated below:

| | |
|---|---|
| ethyl acrylate | 99.9 g |
| hydroxy TEMPO | 1 g |

Example 1 is then repeated, injecting into natural gas 10 mg per Nm$^3$ of the composition according to the invention thus prepared, instead of the tetrahydrothiophene. The content of sulfur dioxide formed, after combustion of the gas thus odorized, is equal to 0 mg/Nm$^3$.

The gas thus odorized is subjected to an olfactory test, from which it emerges that the gas thus odorized has a strong warning power (strong odorous power similar (in intensity) to that of the composition of Example 1).

EXAMPLE 3

The following composition is obtained by simple mixing of the weight of the components indicated in the indicated liquid state:

| | |
|---|---|
| methyl acrylate | 99.9 g |
| N-(tert-butyl)-N-(1-diethylphosphono-2,2-dimethylpropyl) nitroxide | 1 g |

Example 1 is then repeated, injecting into natural gas 10 mg per Nm$^3$ of the composition according to the invention thus prepared, instead of the tetrahydrothiophene. The content of sulfur dioxide formed, after combustion of the gas thus odorized, is equal to 0 mg/Nm$^3$.

The gas thus odorized is subjected to an olfactory test, from which it emerges that the gas thus odorized has a strong warning power (strong odorous power similar (in intensity) to that of the composition of Example 1).

The invention claimed is:

1. A composition used as an odorizer for a gaseous fuel, comprising:

at least one alkyl acrylate (I) in which the alkyl radical contains from 1 to 12 carbon atoms; and at least one compound of formula (II) in an amount of from 50 ppb to 1000 ppm by weight relative to said alkyl acrylate (I) which inhibits the polymerization of the alkyl acrylate (I) and which is stable in the absence of oxygen (II)

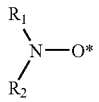

in which:

$R_1$ and $R_2$, which may be identical or different, each represent a tertiary or secondary hydrocarbon-based radical containing from 2 to 30 carbon atoms, and optionally one or more heteroatoms chosen from phosphorus, nitrogen or oxygen; or $R_1$ and $R_2$, taken with the nitrogen atom to which they are attached, form a cyclic hydrocarbon-based radical containing from 4 to 10, said radical being optionally substituted, said composition being essentially free of alkyl sulfide.

2. The composition as claimed in claim 1, wherein the acrylic acrylate (I) is chosen from methyl, ethyl, n-propyl, isopropyl, n-butyl, isobutyl, tert-butyl, pentyl, hexyl, heptyl, octyl or dodecyl acrylates.

3. The composition as claimed in claim 1, wherein the compound of formula (I) is methyl acrylate and/or ethyl acrylate.

4. The composition as claimed in claim 1, wherein the compound of formula (II) is derived from tetramethylpiperidine oxide (TEMPO) of formula (IIa):

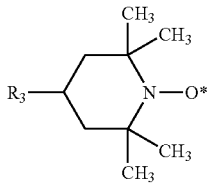

in which $R_3$ represents a hydroxyl, amino, ester or amide group.

5. The composition as claimed in claim 1, wherein the compound of formula (II) is chosen from N-(tert-butyl)-N-(1-[ethoxy(ethyl)phosphino]propyl) nitroxide, N-(tert-butyl)-N-(1-diethylphosphono-2,2-dimethylpropyl) nitroxide or N-(tert-butyl)-N-([2-methyl-l-phenyl]propyl) nitroxide.

6. A process for odorizing an odorless gaseous fuel, comprising adding an effective amount of the composition as defined in claim 1 to an odorless gaseous fuel.

7. The process as claimed in claim 6, characterized in that wherein the gaseous fuel is natural gas.

8. A gaseous fuel comprising an amount of between 1 and 500 mg/Nm$^3$ of the composition as defined in claim 1.

9. The gaseous fuel as claimed in claim 8, wherein it consists of natural gas.

10. The composition of claim 1, wherein said gaseous fuel is natural gas.

11. The composition of claim 1, wherein said alkyl radical contains from 1 to 8 carbon atoms.

12. The composition of claim 1, wherein said hydrocarbon-based radical contains from 4 to 15 carbon atoms.

13. The composition of claim 1, wherein said cyclic hydrocarbon-based radical contains-from 4 to 6 carbon atoms.

14. The composition as claimed in claim 1, wherein the acrylic (I) is chosen from methyl acrylate, ethyl acrylate or n-butyl acrylate.

15. The composition of claim 4, wherein $R_3$ represents $R_3COO$— or $R_3CON$— in which $R_3$ is a $C_1$-$C_4$ alkyl radical.

16. An odorizer for a gaseous fuel, which consists of:

at least one alkyl acrylate (I) in which the alkyl radical contains from 1 to 12 carbon atoms; and only one compound of formula (II) in an amount of from 50 ppb to 1000 ppm by weight relative to said alkyl acrylate (I) which inhibits the polymerization of the alkyl acrylate (I) and which is stable in the absence of oxygen (II)

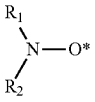

in which:

$R_1$ and $R_2$, which may be identical or different, each represent a tertiary or secondary hydrocarbon-based radical containing from 2 to 30 carbon atoms, and optionally one or more heteroatoms chosen from phosphorus, nitrogen or oxygen; or -$R_1$ and $R_2$, taken with the nitrogen atom to which they are attached, form a cyclic hydrocarbon-based radical containing from 4 to 10, said radical being optionally substituted.

* * * * *